343-755 SR
11/24/87 XR 4,709,240

United States Patent [19]

Bordenave

[11] Patent Number: 4,709,240

[45] Date of Patent: Nov. 24, 1987

[54] RUGGED MULTIMODE ANTENNA

[75] Inventor: John R. P. Bordenave, Morgan Hill, Calif.

[73] Assignee: Lockheed Missiles & Space Company, Inc., Sunnyvale, Calif.

[21] Appl. No.: 730,521

[22] Filed: May 6, 1985

[51] Int. Cl.[4] ..... H01Q 1/28; H01Q 1/40; H01Q 3/24; H01Q 13/08

[52] U.S. Cl. ..... 343/772; 343/705; 343/756; 343/873

[58] Field of Search ..... 343/705, 708, 713, 786, 343/DIG. 2, 772, 773, 775, 776, 780, 784, 789, 795, 700 R, 700 MS, 756, 762, 763, 873, 774, 777, 907; 333/251; 342/350, 354, 367–375, 359

[56] References Cited

U.S. PATENT DOCUMENTS

| | | | |
|---|---|---|---|
| 3,261,018 | 7/1966 | Mast | 343/705 |
| 3,534,376 | 10/1970 | Webb | 343/786 |
| 3,987,458 | 10/1976 | Reggia et al. | 343/708 X |
| 4,270,106 | 5/1981 | Woermbke | 333/251 X |
| 4,287,518 | 9/1981 | Ellis, Jr. | 343/708 X |

*Primary Examiner*—Marvin L. Nussbaum
*Attorney, Agent, or Firm*—John J. Morrissey

[57] ABSTRACT

A compact antenna for an extra-atmospheric vehicle is sufficiently rugged to withstand the rigors of atmospheric re-entry, and is capable of transmitting and receiving radio-frequency signals with selectable polarizations over a broad frequency bandwidth.

20 Claims, 3 Drawing Figures

FIG_1
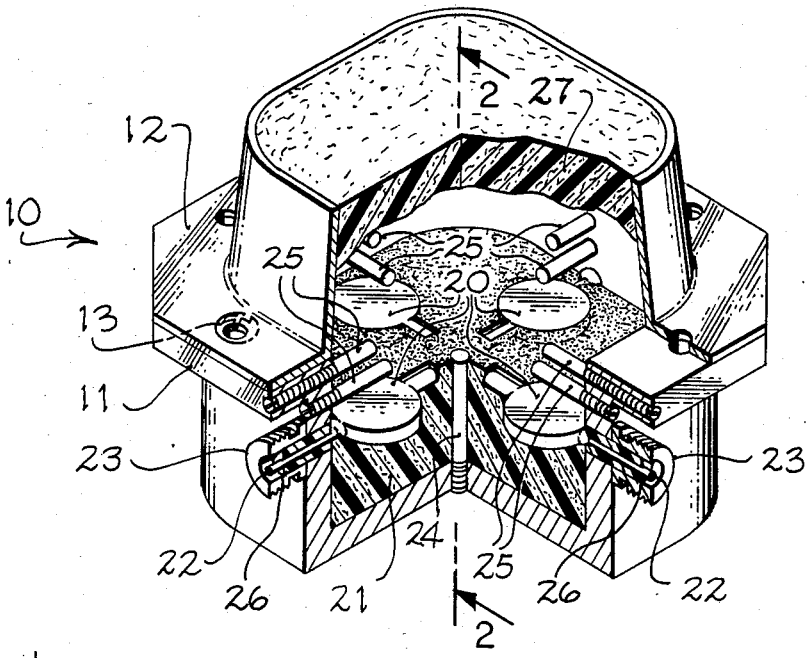
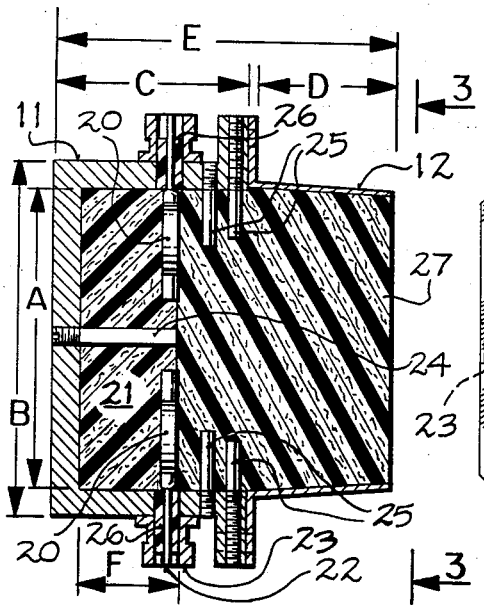
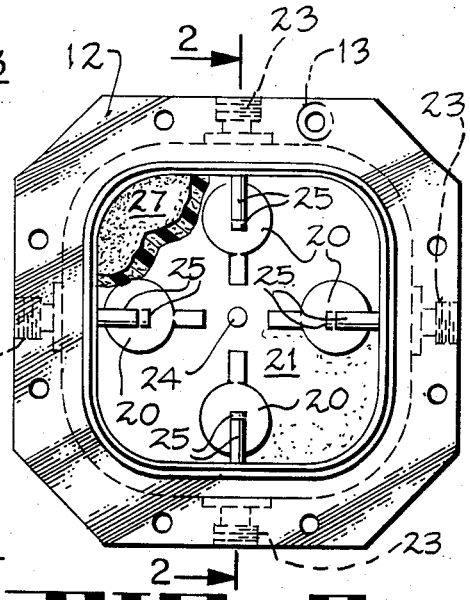
FIG_2 FIG_3

RUGGED MULTIMODE ANTENNA

TECHNICAL FIELD

This invention pertains to rugged and compact antennas for transmitting and receiving sum and difference patterns of electromagnetic energy with selectable polarizations over a broad bandwidth, particularly for use on atmospheric re-entry vehicles.

BACKGROUND ART

On an atmospheric re-entry vehicle such as a space shuttle, a sounding rocket or a ballistic missile, a number of separate radio-frequency antennas are normally installed to perform different communication functions simultaneously. Each such antenna is of compact configuration and rugged construction to withstand the rigors of atmospheric re-entry. Typically, each such antenna transmits and/or receives only single-mode radiation patterns with only one polarization and in only a narrow frequency bandwidth.

SUMMARY OF THE INVENTION

The present invention provides a compact antenna, which is sufficiently rugged to withstand the rigors of atmospheric re-entry on a hypervelocity extra-atmospheric vehicle, and which transmits and receives multifunction (i.e., sum and difference) patterns of electromagnetic energy with selectable polarizations over a broad frequency bandwidth.

An antenna according to the present invention is of the radiating-aperture type, and comprises an electrically conductive housing structure that is generally symmetrical about a cylindrical axis. One end of the housing structure defines a radiating aperture, which has a squarish configuration with rounded corners in a plane perpendicular to the cylindrical axis. Each side of the squarish radiating aperture is shorter than one-half a specified longest free-space wavelength for the antenna.

Four metals probes, which are substantially identical to each other and are preferably of "ping-pong paddle" configuration, are positioned within the housing structure. Each probe has a generally circular "paddle" portion with an elongate "handle" portion extending therefrom. The probes are mounted symmetrically with respect to each other on corresponding side walls of the housing structure, and the elongate "handle" portions of the probes point toward (without reaching) the axis of the housing structure. The probes can be selectively energized, individually or in various combinations, with radio-frequency energy to establish selected radiation mode patterns and selected polarizations.

Mode suppressors are mounted within the housing structure to prevent spurious modes from developing, and an isolation post is mounted along the axis of the housing structure to control cross-polarization. The probes, the mode suppressors and the isolation post are surrounded by low-loss, low-ablation dielectric material to compensate for the small physical size of the antenna, so that electromagnetic energy can be transmitted and received at wavelengths longer than twice the length of the sides of the radiating aperture.

An antenna according to the preferred embodiment of the present invention is compact, rugged and re-entry survivable, and is also "hardened" to maintain functional capability in a hostile radiation environment following a nuclear explosion.

DESCRIPTION OF THE DRAWING

FIG. 1 is a cut-away perspective view of a rugged multimode antenna according to the present invention.

FIG. 2 is a cross-sectional view of the antenna of FIG. 1 along line 2—2 of FIG. 1.

FIG. 3 is a plan view (partially cut away) of the antenna of FIG. 1 along line 3—3 of FIG. 2.

BEST MODE OF CARRYING OUT THE INVENTION

An antenna according to a preferred embodiment of the present invention is shown in perspective view in FIG. 1. The antenna is of the radiating-aperture type, and comprises an electrically conductive housing structure 10 defining a cylindrical resonant cavity having a generally squarish cross section in a plane perpendicular to the axis of the cavity. An open end of the housing structure 10 defines the radiating aperture of the antenna.

The housing structure 10 comprises a flanged cup-like base member 11 having a substantially square interior cross section transverse to the cylindrical axis, and a matingly flanged chimney member 12 having a squarish interior cross section (but with rounded corners) transverse to the cylindrical axis. The base member 11 and the chimney member 12 are secured together in a conventional manner, as by screws 13 disposed at uniform intervals around their mated flange portions. The chimney member 12 tapers inwardly from the flanged connection with the base member 11 to the radiating aperture at the open end of the housing structure 10. Tapering of the chimney member 12 provides mechanical containment for a dielectric material (discussed hereinafter) within the housing structure 10.

In principle, from the standpoint of transmitting and receiving electromagnetic signals, the housing structure 10 could have been designed as an integral structure. However, to optimize the ability of the antenna to function in a hostile radiation environment following a nuclear explosion, the base member 11 is made of a metal of low atomic number such as aluminum or beryllium, and the chimney member 12 is made of an electrically conductive graphite material such as Grafoil marketed by Union Carbide Corporation. The aluminum (or beryllium) is substantially transparent to X-rays that would be produced in a nuclear explosion, and the graphite material is resistant to ablation at the high temperatures that would result from proximity to a nuclear explosion.

The compactness achievable for an antenna according to the present invention can be appreciated from the dimensions of the preferred embodiment indicated by the letters A, B, C, D, E and F in FIG. 2. The antenna shown in FIG. 2, which is capable of radiating and receiving electromagnetic signals simultaneously in the frequency band from 2 GHz to 5 GHz for all polarizations, has the following dimensions:

| | | |
|---|---|---|
| A | (a side of the square interior cross section of the base member 11) | 5.6 cm |
| B | (a side of the square exterior cross section of the base member 11) | 6.2 cm |
| C | (the axial dimension of the base member 11) | 3.3 cm |
| D | (the axial dimension of the chimney member 12) | 2.6 cm |
| E | (the axial dimension of the antenna) | 6.0 cm |
| F | (the axial dimension of the interior | 1.6 cm |

-continued

| |
|---|
| of the base member 11) |

The above-listed dimentions are illustrative, but are not critical.

Four metal probes 20 are mounted within the resonant cavity so that each probe 20 extends from a corresponding one of the side walls of the base member 11 toward (without reaching) the cylindrical axis of the cavity. Each probe 20 is of "ping-pong paddle" configuration, and has a generally circular plate-like "paddle" portion with a rod-like "handle" portion extending therefrom. The probes 20 are substantially coplanar with each other, and the "handle" portions thereof point toward the axis of the resonant cavity.

Optimally, the segment of the perimeter of the "paddle" portion of each probe 20 opposite the corresponding wall of the base member 11 would have the shape of an exponential curve. However, it is generally easier to fabricate the probes 20 so as to provide each "paddle" portion with a circular perimeter rather than with a perimeter having an exponentially curved segment; and furthermore, a circular perimeter provides a satisfactory approximation of an exponentially curved perimetrical segment in the vicinity of the cavity wall. The probes 20 can be energized either individually or in selected combinations by radio-frequency energy to establish desired sum or difference radiation modes within the resonant cavity.

It is a feature of an antenna according to the present invention that a side of the radiating aperture is shorter than one-half the longest free-space wavelength specified for the antenna. This is accomplished by surrounding the probes 20 with dielectric material having a permittivity greater than 2.5.

As indicated in FIGS. 1 and 2, a dielectric body 21 made of slip-cast fused silica, whose dielectric properties are substantially equivalent to those of woven quartz, is fitted into the cup-like base member 11. The dielectric body 21 has a generally cylindrical configuration of square transverse cross section as defined by the side walls of the base member 11. A top surface of the dielectric body 21 is machined to provide pockets configured to receive and support the four paddle-shaped probes 20. Rigid electrical leads 22 are connected to the probes 20. Electrical connectors 23 (which may be of a conventional kind) are inserted through apertures in the side walls of the base member 11, and the electrical leads 22 extend from the probes 20 axially through the corresponding connectors 23 to switching means (which may be conventional) for selectively energizing the probes 20.

A bore is provided through the dielectric body 21 along the cylindrical axis of the resonant cavity to receive a metal isolation post 24, which serves to minimize cross-polarization among the probes 20. One end of the isolation post 24 is secured by a screw-threaded connection to the bottom of the cup-like base member 11, and the other end of the isolation post 24 extends into the resonant cavity to the top surface of the dielectric body 21 defining the plane of the outwardly facing surfaces of the probes 20. Fine tuning of the antenna for control of cross-polarization can be achieved by screw-threaded adjustment of the length of the isolation post 24 within the resonant cavity.

Mode suppressors 25 extend from the side walls of the base member 11 into the resonant cavity to suppress development of spurious radiation modes within the cavity. In the preferred embodiment, there are a total of eight rod-like mode suppressors 25 arranged into four groups of two. Each group of two mode suppressors 25 is mounted on a corresponding one of the side walls of the base member 11. All of the mode suppressors 25 point toward (without reaching) the cylindrical axis of the resonant cavity. Both of the mode suppressors 25 in the group secured to a particular one of the walls of the base member 11 are aligned with the "handle" portion of the particular probe 20 whose "paddle" portion is positioned adjacent the same wall. The mode suppressors 25 function as tuned rods, and are mounted by screw-threaded insertion into threaded holes on the side walls of the base member 11. Fine tuning of the antenna to prevent spurious modes from developing can be achieved by screw-threaded adjustment of the lengths of the individual mode suppressors 25 within the resonant cavity.

Mechanical stability for the electrical leads 22 can be enhanced by surrounding each lead 22 with a sleeve 26 made of an electrically insulating material such as polytetrafluoroethylene (Teflon), which fills the void between the lead 22 and the interior surface of the surrounding connector 23. The connectors 23 are preferably made of beryllium. The probes 20, the isolation post 24 and the mode suppressors 25 are likewise preferably made of aluminum in order to achieve transparency with respect to radiation in the X-ray region of the electromagnetic spectrum.

The interior of the resonant cavity between the top surface of the fused silica dielectric body 21 and the radiating aperture at the distal end of the chimney member 12 is filled with a three-dimensionally woven quartz packing 27 such as AS3DX marketed by Ford Aerospace and Communications Corporation. In this way, the probes 20, the isolation post 24, and the mode suppressors 25 are completely surrounded by dielectric material.

The resonant cavity of the antenna dimensioned as described above, when dielectrically loaded with the fused silica dielectric block 21 and the woven quartz packing 27, permits signals to be transmitted and received at frequencies as low as 2.0 GHz. The mode suppressors 25 effectively suppress overmoding at frequencies up to 5.0 GHz. Thus, the antenna of the present invention has a continuous operational bandwidth greater than one octave, where an octave is defined as a bandwidth for which the ratio of the highest frequency to the lowest frequency is two-to-one.

Depending upon which particular combination of the probes 20 is energized at any particular time, the pattern of electromagnetic energy coupled through (i.e., radiated from and/or received by) the aperture of the antenna can selectively have vertical polarization, horizontal polarization, oblique polarization, right-hand circular polarization, or left-hand circular polarization. Furthermore, it is possible to transmit signals having one polarization and to receive signals having another polarization simultaneously, which can be accomplished by means of a conventional network comprising two 180° hybrid couplers (one for each polarization plane) and a 90° hybrid coupler for obtaining circular polarization only.

On an atmospheric re-entry vehicle, the antenna of the present invention would be mounted so that the radiating aperture of the antenna is flush with the heat shield of the re-entry vehicle, and so that the chimney member 12 and the base member 11 are buried within the material comprising the heat shield of the vehicle. The base member 11 has sufficient mechanical strength to withstand shocks due to compressive forces imparted to the dielectric material of the antenna by an explosive detonation in the vicinity of the re-entry vehicle. The dielectric body 21, being a solid block with a relatively large area of contact with the woven quartz packing 27, is designed to absorb the energy in the compressive forces passing through the woven quartz packing 27. Even if the dielectric body 21 were to be cracked or shattered by such compressive forces, the material comprising the dielectric body 21 would remain contained within the cup-like base member 11 and would continue to function as a dielectric material for purposes of electromagnetic signal transmission and reception.

The tapering of the chimney member 12 toward the radiating aperture serves to retain the woven quartz packing 27 within the resonant cavity despite centrifugal forces tending to eject the packing 27 from the cavity when the re-entry vehicle undergoes sudden accelerations and decelerations involving changes in direction. The chimney member 12, being made of a graphite material, is able to withstand the extreme heat associated with plasma generated adjacent the surface of the vehicle during atmospheric re-entry, and therefore undergoes minimum ablation.

A perfectly square configuration for the radiating aperture would be optimal for coupling the smallest radiation mode at the lowest frequency. However, at the junction between the woven quartz packing 27 and the surrounding graphite chimney member 12 around the perimeter of the radiating aperture, the packing 27 is especially susceptible to differential ablation caused by plasma flowing parallel to the junction. To minimize differential ablation at the perimeter of the radiating aperture, the corners of the aperture are rounded. Rounding of the corners of the radiating aperture reduces the total length of the segments of the perimeter that would actually be parallel to the direction of plasma flow adjacent the surface of the re-entry vehicle at any given time. Thus, rounding of the aperture corners provides a compromise between the design goal of supporting the lowest possible radiation mode at the lowest possible frequency and the competing goal of minimizing differential ablation.

A description has been presented herein of a particular embodiment of a rugged multimode antenna according to the present invention. However, practitioners skilled in the antenna art upon perusing the foregoing specification and the accompanying drawing would be able to devise other embodiments of the invention especially suitable for particular applications. Thus, the foregoing description is to be understood as illustrating the invention, which is more generally defined by the following claims and their equivalents.

I claim:

1. An antenna comprising:

(a) an electrically conductive housing structure generally symmetrical about a cylindrical axis, said housing structure including:

(i) a cup-like base member, said base member having a generally square-shaped cross-sectional configuration in a plane perpendicular to said cylindrical axis, said base member having an outwardly flanged rim portion; and (ii) a chimney member, a first end of said chimney member being outwardly flanged to abut said flanged rim portion of said base member, said flanged first end of said chimney member being attached to said flanged rim portion of said base member so that said base member and said chimney member together form a resonant cavity, a second end of said chimney member defining a squarish aperture with curved corners, said chimney member tapering inwardly with respect to said cylindrical axis from said first end attached to said base member to said second end defining said aperture, each side of said aperture being shorter than one-half a specified longest free-space wavelength for said antenna;

(b) a plurality of probes mounted in said cavity, said probes functioning to couple electromagnetic energy through said aperture at free-space wavelengths longer than twice said side of said aperture;

(c) means for energizing selected ones of said probes to enable said electromagnetic energy coupled through said aperture to have a selected polarization;

(d) a plurality of mode suppressors mounted in said cavity, said mode suppressors functioning to prevent spurious modes of said electromagnetic energy from developing in said antenna;

(e) an isolation post mounted in said cavity along said cylindrical axis, said isolation post functioning to control cross-polarization of said electromagnetic energy coupled through said aperture; and (f) dielectric material within said cavity substantially surrounding said probes, said mode suppressors and said isolation post; said dielectric material enabling said electromagnetic energy to be coupled through said aperture at wavelengths longer than twice said side of said aperture over a continuous frequency bandwidth greater than one ocatve.

2. The antenna of claim 1 wherein said base member is made of a metal having an atomic number no higher than the atomic number for aluminum, and wherein said chimney member is made of an electrically conductive graphite material.

3. The antenna of claim 1 wherein said plurality of probes comprises four probes, each of said probes being mounted on a corresponding side wall of said base member and extending into said resonant cavity toward said cylindrical axis, said probes being symmetrically disposed with respect to each other around said axis.

4. The antenna of claim 3 wherein each of said probes has a plate-like portion and a rod-like portion, said plate-like portion being of generally circular configuration and being positioned adjacent a corresponding one of said side walls of said resonant cavity, said rod-like portion extending from said plate-like portion toward said cylindrical axis.

5. The antenna of claim 4 wherein said plurality of mode suppressors comprises four groups of mode suppressors, each group of mode suppressors being mounted on a corresponding one of said side walls of said base member and extending toward said cylindrical axis, the mode suppressors of each group being aligned with the rod-like portion of the probe whose plate-like portion is positioned adjacent the same one of said side walls.

6. The antenna of claim 5 wherein said mode suppressors are mounted in screw-threaded recesses in said side walls, said mode suppressors functioning by screw-threaded adjustment to fine-tune said resonant cavity so as to prevent said spurious modes from developing in said antenna.

7. The antenna of claim 3 wherein said means for energizing selected ones of said probes comprises electrical leads extending through corresponding apertures in said side walls, said electrical leads functioning to connect said probes to electrical switching means for selectively connecting said probes to a source of radio-frequency energy.

8. The antenna of claim 3 wherein said dielectric material comprises fused silica within said base member and woven quartz within said chimney member, said fused silica surrounding a major portion of said isolation post and supporting said probes in symmetrical disposition around said cylindrical axis, said woven quartz substantially surrounding said mode suppressors.

9. The antenna of claim 1 wherein said isolation post is mounted in a screw-threaded recess in said base member so as to extend into said resonant cavity along said cylindrical axis, said isolation post functioning by screw-threaded adjustment to fine-tune said cavity so as to control said cross-polarization.

10. An antenna comprising:

(a) an electrically conductive housing structure generally symmetrical about a cylindrical axis, said housing structure forming a resonant cavity, an open end of said housing structure defining a squarish aperture with curved corners, a side of said aperture being shorter than one-half a specified longest free-space wavelength for said antenna;

(b) four probes mounted on said housing structure so as to extend into said resonant cavity toward said cylindrical axis, said probes being symmetrically disposed with respect to each other around said axis in a plane substantially perpendicular to said axis, said probes functioning to couple electromagnetic energy through said aperture at free-space wavelengths longer than twice said side of said aperture;

(c) means for energizing selected ones of said probes to enable said electromagnetic energy coupled through said aperture to have a selected polarization;

(d) a plurality of mode suppressors mounted in said cavity, said mode suppressors functioning to prevent spurious modes of said electromagnetic energy from developing in said antenna;

(e) an isolation post mounted in said cavity along said cylindrical axis, said isolation post functioning to control cross-polarization of said electromagnetic energy coupled through said aperture; and (f) dielectric material within said cavity substantially surrounding said probes, said mode suppressors and said isolation post; said dielectric material enabling said electromagnetic energy to be coupled through said aperture at wavelengths longer than twice said side of said aperture over a continuous frequency bandwidth greater than one octave.

11. The antenna of claim 10 wherein said housing structure has a base portion of generally square-shaped cross-sectional configuration in a plane perpendicular to said cylindrical axis, and a chimney portion that tapers inwardly from said base portion to said aperture.

12. The antenna of claim 11 wherein said base portion of said housing structure is a separate base member, and wherein said chimney portion of said housing structure is a separate chimney member, a flanged portion of said base member being secured to a flanged portion of said chimney member to form said resonant cavity.

13. The antenna of claim 12 wherein said base member is made of a metal having an atomic number no higher than the atomic number for aluminum, and wherein said chimney member is made of an electrically conductive graphite material.

14. The antenna of claim 12 wherein each of said probes is mounted on a corresponding side wall of said base member.

15. The antenna of claim 14 wherein each of said probes has a plate-like portion and a rod-like portion, said plate-like portion being of generally circular configuration and being positioned adjacent a corresponding one of said side walls of said resonant cavity, said rod-like portion extending from said plate-like portion toward said cylindrical axis.

16. The antenna of claim 15 wherein said plurality of mode suppressors comprises four groups of mode suppressors, each group of mode suppressors being mounted on a corresponding one of said side walls of said base member and extending toward said cylindrical axis, the mode suppressors of each group being aligned with the rod-like portion of the probe whose plate-like portion is positioned adjacent the same one of said side walls.

17. The antenna of claim 16 wherein said mode suppressors are mounted in screw-threaded recesses in said side walls, said mode suppressors functioning by screw-threaded adjustment to fine-tune said resonant cavity so as to prevent said spurious modes from developing in said antenna.

18. The antenna of claim 14 wherein said means for energizing selected ones of said probes comprises electrical leads extending through corresponding apertures in said side walls, said electrical leads functioning to connect said probes to electrical switching means for selectively connecting said probes to a source of radio-frequency energy.

19. The antenna of claim 14 wherein said dielectric material comprises fused silica within the base member and woven quartz within said chimney member, said fused silica surrounding a major portion of said isolation post and supporting said probes in symmetrical disposition around said cylindrical axis, said woven quartz substantially surrounding said mode suppressors.

20. The antenna of claim 12 wherein said isolation post is mounted in a screw-threaded recess in said base member so as to extend into said resonant cavity along said cylindrical axis, said isolation post functioning by screw-threaded adjustment to fine-tune said cavity so as to control said cross-polarization.

* * * * *